United States Patent [19]

Rauch et al.

[11] Patent Number: 4,520,335

[45] Date of Patent: May 28, 1985

[54] TRANSFORMER WITH FERROMAGNETIC CIRCUITS OF UNEQUAL SATURATION INDUCTIONS

[75] Inventors: Gary C. Rauch; Robert F. Krause, both of Murrysville, Pa.

[73] Assignee: Westinghouse Electric Corp., Pittsburgh, Pa.

[21] Appl. No.: 482,681

[22] Filed: Apr. 6, 1983

[51] Int. Cl.[3] ..... H01F 27/24

[52] U.S. Cl. ..... 336/212; 336/218

[58] Field of Search ..... 336/211, 212, 213, 218, 336/233, 234

[56] References Cited

U.S. PATENT DOCUMENTS

| | | | |
|---|---|---|---|
| 2,498,475 | 2/1950 | Adams | 336/212 X |
| 3,339,163 | 8/1967 | Wentz et al. | 336/212 X |
| 3,617,965 | 11/1971 | Trench et al. | 336/212 X |
| 3,856,513 | 12/1974 | Chen et al. . | |
| 4,205,288 | 5/1980 | Lin et al. | 336/212 X |
| 4,364,020 | 12/1982 | Lin et al. . | |

FOREIGN PATENT DOCUMENTS

| | | | |
|---|---|---|---|
| 12409 | 1/1979 | Japan | 336/212 |

OTHER PUBLICATIONS

"The Making, Shaping and Treating of Steel", Edited by McGannon, U.S. Steel, (1971), pp. 1157–1162.

*Primary Examiner*—A. D. Pellinen

*Attorney, Agent, or Firm*—John J. Prizzi

[57] ABSTRACT

Ferromagnetic cores and electric transformers having a ferromagnetic core having at least two ferromagnetic circuits are described. At least one ferromagnetic circuit is composed of a ferromagnetic amorphous material and at least one ferromagnetic circuit is composed of a grain oriented electrical steel. The amorphous material having a saturation induction which is lower than that of the grain oriented steel. Methods of fabricating the core and using the transformer are also described.

18 Claims, 6 Drawing Figures

TRANSFORMER WITH FERROMAGNETIC CIRCUITS OF UNEQUAL SATURATION INDUCTIONS

BACKGROUND OF THE INVENTION

The invention relates in general to electrical transformers, and more specifically to electrical power and distribution transformers used in the transmission and distribution of electrical energy.

The ferromagnetic materials used in ferromagnetic cores of electrical power and distribution transformers have been improved greatly over the years, enabling the size and manufacturing costs of a transformer to be reduced. In general the grain oriented electrical steels used in electrical power and distribution transformers may be classified as: (1) regular grain oriented silicon steels, such as AISI M-3 through M-8, having a physical saturation induction about 2.03 teslas (20.3 kilogauss); and (2) high permeability grain oriented silicon steel which provide lower losses but still having a physical saturation induction of 2.03 tesla induction.

The steels in these conventional cores is not uniformly magnetized because of the variation in magnetic path length and consequent variation in magnetic field with radial position in the core. The inner material operates at a higher induction than the average induction of the core, and the outer material at a lower induction than the average. The steel in the outer portion of the core is thus not used to its full potential. Nonetheless, the steel comprising the outer portions of the core accounts for a significant part of the losses in the core.

Amorphous ferromagnetic alloys contain a transition metal selected from the group of ferromagnetic elements, i.e., iron, cobalt and nickel, alloyed with a metalloid which may include boron, carbon, phosphorus and/or silicon. The transition metal comprises the bulk of the alloy, typically about 80% on an atomic percent basis. For transformer core applications iron base amorphous alloys have been preferred because of their lower cost.

Amorphous ferromagnetic materials have the potential for producing low-loss transformer cores, particularly in high frequency applications, for which their high electrical resistivity is particularly advantageous. For power frequency transformers, however, the relatively low physical saturation induction of amorphous materials (compared to grain oriented electrical steels) requires larger core volumes, with consequent increase in costs associated with coils, tanks and insulation compared with conventional cores. These amorphous materials generally have a physical magnetic saturation of about 1.6 teslas (16,000 gauss), which decreases rapidly with increasing temperature.

The maximum operating induction of a transformer core is set by the requirement that, at 10% overvoltage, the exciting current be low enough that the temperature rise does not exceed the specified limit. A transformer operating at this maximum induction is said to be "saturation limited", although in the strict sense of the term "saturation" this 10% overvoltage point on the B-H curve is still below the physical saturation value. For example, a core made of HIPERSIL (grain oriented steel) can operate (at 100% voltage) at an induction of 17.5–18.0 kG, while a core made of the amorphous alloy METGLAS 2605 S-2 is designed at present to operate (at 100% voltage) only at 13 kG (assuming 10% overvoltage at 100° C.). HIPERSIL is a trademark of the Westinghouse Electric Corporation of Pittsburgh, Pa. for its magnetic metal alloys. METAGLAS is a trademark of the Allied Corp. of Morristown, N.J. for its amorphous alloys.

Most transformers are now designed by an optimization procedure which minimizes the total cost (initial cost plus cost of losses) of owning the transformer. When such an optimization procedure is applied to a core made of regular grain oriented electrical steels, such as Hipersil (M4 or M5 grade), the operating induction is well below the saturation limit for all meaningful loss evaluations; the higher the loss evaluation, the lower the induction. However, when such an optimization procedure is applied to a core made of a ferromagnetic amorphous material, the core is saturation limited. This result means that full advantage cannot be taken of the low loss characteristics of the amorphous material. If a design could be found which would allow the amorphous material to operate above its saturation limited induction, less of the expensive amorphous material would be needed, and a more cost efficient transformer would result.

Applicants have addressed these problems and found that amorphous ferromagnetic materials may be used to advantage in an electrical power transformer for transmitting and distributing electrical power in an electric power system by constructing the ferromagnetic core of the transformer so as to include a plurality of ferromagnetic circuits in which at least one of the ferromagnetic circuits is constructed of a ferromagnetic amorphous material and at least one of the circuits is constructed of a grain oriented electrical steel. The applicants have found that by mixing amorphous material, which has a low magnetic saturation induction compared to the grain oriented steel, with grain oriented silicon steel, a transformer core is produced which has the ability to use amorphous materials at inductions greater than the saturation limited induction of the amorphous material.

In addition, applicants have found that, when in the transformer according to the present invention, the amorphous material is concentrically adjacent to and outside of the grain oriented electrical steel, core losses at a specified induction can be minimized compared to an all grain oriented electrical steel transformer core for most operating inductions.

In addition to the advantage of the invention already noted, the composite core according to the present invention may preferably be designed such that the structurally more rigid grain oriented electrical steel serves as a support and/or enclosure for the flimsy and brittle amorphous material. In this embodiment, the wasted space associated with supports or enclosures are reduced since the grain oriented electrical steel is magnetically active.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DETAILED DESCRIPTION OF THE INVENTION

The present invention pertains to composite ferromagnetic cores, transformers containing these composite cores, the method of manufacturing such composite ferromagnetic cores and the method of using transformers containing these composite cores. The composite core is constructed of an amorphous ferromagnetic material and a grain oriented electrical steel, the amorphous material having a physical saturation induction significantly below that of the grain oriented electric steel, and typically being about 80% or less of the physical saturation induction of the oriented electric steel. The permeability of the amorphous material is at least about 50 percent of the permeability of the grain oriented steel at inductions up to about 15 kG. Preferably, the permeability of the amorphous material is about equal to or greater than the permeability of the grain oriented steel at inductions up to about 15 kG. As used in the present invention, the grain oriented electrical steel has an insulative coating on its surface which may be a mill-glass and/or stress coating. The amorphous material may or may not have an insulative coating. The composite core contains at least one ferromagnetic circuit or loop of each of the two types of materials. The amorphous material loop or loops may be combined with the grain oriented loop or loops as desired for particular applications.

The invention will be further clarified by a consideration of the following examples, which are intended to be purely illustrative of the invention.

Figure 1:
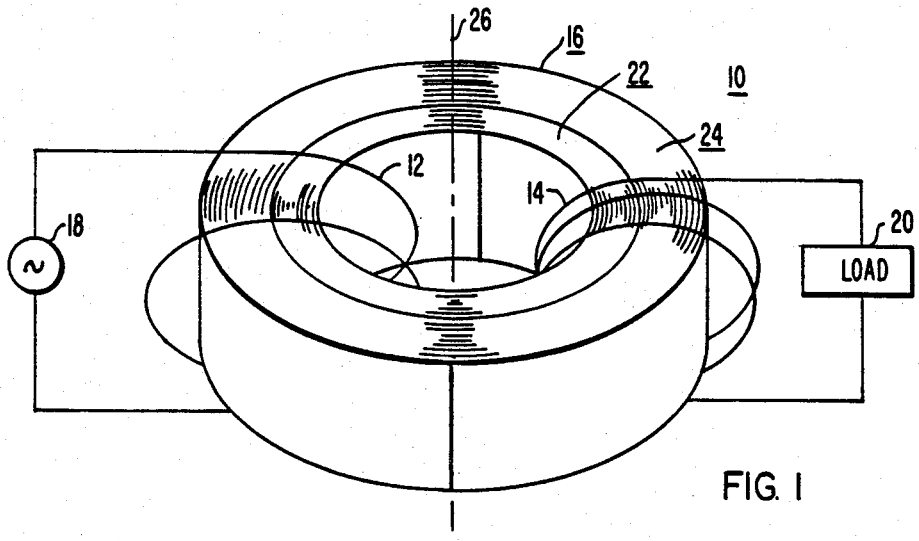
FIG. 1 is a partially schematic and partially diagrammatic perspective view of an electrical transformer constructed according to the teachings of the invention.

FIG. 1 illustrates a first embodiment of the invention, wherein the concept of the invention is applied to wound-type ferromagnetic core construction. More specifically, FIG. 1 is a partially schematic and partially diagrammatic view of an electrical transformer 10 having primary and secondary windings 12 and 14, respectively, disposed in inductive relation with a ferromagnetic core 16 of the wound type. The primary winding 12 is adapted for connection to a source 18 of alternating potential, and the secondary winding 14 is adapted for connection to a load circuit 20.

Figure 2:
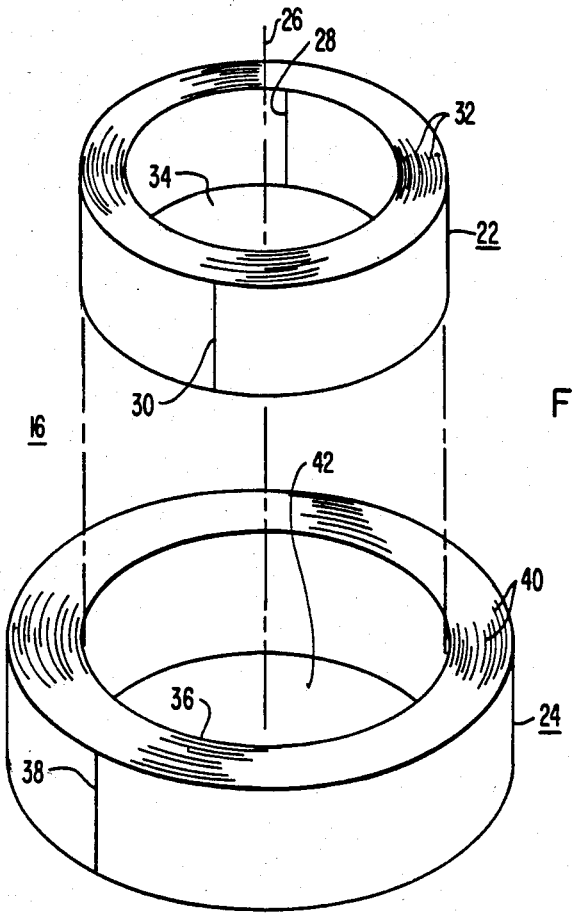
FIG. 2 is an exploded perspective view of the wound composite ferromagnetic core of the electrical transformer shown in FIG. 1.

The ferromagnetic core 16, shown in an exploded perspective view in FIG. 2, is a composite ferromagnetic core having inner and outer sections or loops 22 and 24 disposed in concentric adjacent relation about a common central axis 26. Sections 22 and 24 are constructed of ferromagnetic sheet materials having different physical magnetic saturations, an amorphous ferromagnetic material in one loop and a grain oriented electrical steel for the other loop. While the amorphous or lower saturation material may be used in either the inner loop 22 or outer loop 24, in order to minimize core losses, the amorphous material is preferably used in outer loop 24.

The ferromagnetc sheet materials are wound to provide a plurality of superposed, nested turns, with the sheet material of loop 22 starting at 28 and ending at 30, creating a plurality of nested turns 32 which extend between an inner opening or window 34 and an outer surface which defines a predetermined outside diameter.

The sheet material of loop 24 starts at 36, adjacent to end 30 of the sheet material of loop 22, and it ends at 38, creating a plurality of nested turns 40 which extend between an opening 42 having an inside diameter which is substantially the same as the outside diameter of loop 22, and an outer surface which defines a predetermined diameter.

It should be noted that the inner and outer loops 22 and 24, respectively, define parallel ferromagnetic circuits for the magnetic flux induced into the ferromagnetic core 16 by the primary winding 12, and that the mean or average length of loop 22 is shorter than that of loop 24.

In accordance with the present invention, the loop composed of the grain oriented steel is wound and then stress relief annealed separately from the amorphous loop which cannot tolerate the temperatures required to stress relief anneal the grain oriented loop. The amorphous material may be wound around a mandrel or around the annealed grain oriented loop when the grain oriented material comprises the inner loop 22. The amorphous material loop may then be annealed alone or after combination with the grain oriented loop with or without a magnetic field. The method of making, and using transformer cores and transformers according to the present invention, as well as the advantages of these devices over all grain oriented and all amorphous devices will become more apparent upon review of the following illustrative working examples.

The four toroidal wound transformer loops listed in Table I and appearing substantially as those shown in FIGS. 1 and 2, were fabricated. The silicon steel loops were made by winding a high permeability grain-oriented silicon steel on a power mandrel. This silicon steel was nominally 11 mil thick, 1 inch wide, TRAN-COR H, having a mill glass coating. TRAN-COR H is a trademark of the ARMCO Inc. of Middletown, Ohio. Each of the silicon steel loops were stress relief annealed after winding at 800° C. for 2 hours in a dry hydrogen atmosphere.

Two amorphous loops were made by winding non-coated METGLAS Alloy 2605 SC ribbon having a nominal thickness of 1 mil and a width of 1 inch on a power driven mandrel. METGLAS alloy 2605 SC has a nominal composition on an atomic percent basis of 81% iron, 13.5% boron, 3.5% silicon and 2% carbon. After winding, each amorphous loop was magnetic field annealed by holding it at 400° C. for 2 hours in an argon atmosphere while in the presence of an applied magnetic field produced by a DC current of 15 amperes applied to a 10 turn coil wrapped around the loop.

TABLE I

| Loop | Inside Diameter (cm) | Outside Diameter (cm) | Weight (gm) | Nominal Area ($cm^2$) | Calculated Area ($cm^2$) | Space Factor (%) |
|---|---|---|---|---|---|---|
| Large Silicon Steel | 8.09 | 10.63 | 671.9 | 3.23 | 2.99 | 93 |
| Small Silicon Steel | 5.67 | 8.00 | 458.3 | 2.96 | 2.78 | 94 |
| Large Amorphous | 8.00 | 10.53 | 461.1 | 3.21 | 2.18 | 68 |
| Small Amorphous | 5.74 | 7.99 | 298.2 | 2.86 | 1.89 | 66 |

With the loop dimensions shown in Table I, any combination of large and small loops could be assemblied to form either an all grain oriented core, an all amorphous core, a composite core according to the present invention having an inner amorphous loop and an outer grain oriented loop, or a composite core according to the present invention having an inner grain oriented loop and an outer amorphous loop.

The cross-sectional areas were calculated from the diameters, the weights, and the densities (7.65 g/$cm^3$ for the silicon steel; 7.30 g/$cm^3$ for the amorphous material). The space factor was obtained as the ratio of the calculated area to the nominal area, given by $\frac{1}{2}$ [(outside diameter)-(inside diameter)]$\times$(width). It is significant to note that the space factor for the amorphous material is significantly less than that for the silicon steel, so that the amorphous material carries less flux than the silicon steel for a given induction and nominal core or loop size. (Somewhat higher space factors are expected in practice, but still less than for silicon steel.) This represents a disadvantage for the amorphous material which worsens the problem of lower saturation. The present invention provides a design which overcomes both of these problems and uses amorphous materials advantageously.

Figure 3:
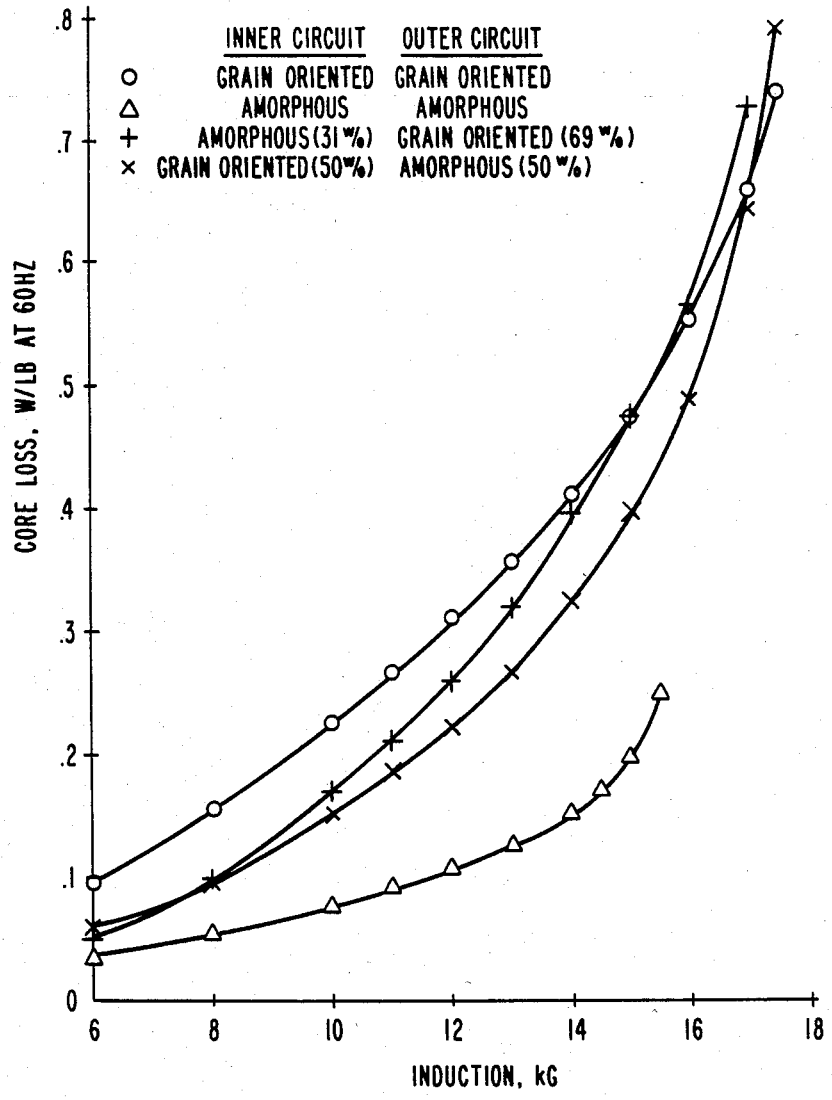
FIG. 3 is a graph of core loss versus induction for a core constructed with all high permeability grain oriented material, a core constructed with all amorphous material, and two composite cores constructed of a high permeability grain oriented and an amorphous material.

FIG. 3 shows core loss (watts per pound at 60 Hz) as a function of overall, or nominal, core induction for the aforementioned cores produced by assembling two Table I loops together. (Measurements on individual large and small loops showed good agreement for each material.) In this test, both composite cores according to the present invention had lower core losses than the all silicon steel core up to inductions of about 15 kG, and the composite core with amorphous material on the outside had the lower core losses of the two composite cores. Though the core losses of the composite core with the amorphous material on the outside were higher than the weight-averaged core losses of the separate TRAN-COR H and METGLAS 2605 SC core losses at the same induction, for most inductions tested, the loss reduction is still very significant. For example, at an induction of 14 kG, the composite core (amorphous on the outside) had core losses 22% lower than the all TRAN-COR H core. The operating induction of the all TRAN-COR H core would need to be lowered to almost 12 kG to achieve a similar loss (see FIG. 3).

METGLAS 2605 SC has a physical saturation induction of about 16 kG and therefore a saturation limited induction, defined as 85% of the room temperature physical saturation induction, of about 13.6 kG. While we could not test the all amorphous core above 15.5 kG, we did find that even about 16 kG, the composite core with amorphous material in the outside loop had a core loss advantage over the all TRAN-COR H core as shown in FIG. 3. This ability to use a ferromagnetic amorphous material, in a core operating above its saturation limited induction, is one of the critical achievements of the present invention.

The permeability of ferromagnetic amorphous alloys varies from alloy to alloy, and for any specific alloy, it is also a function of induction. In some cases, it is higher than that found in high permeability grain oriented steel and in the other cases, lower. Either high or low permeability amorphous material may be used in the present invention if the sole goal of the invention were to reduce core losses.

Figure 4:
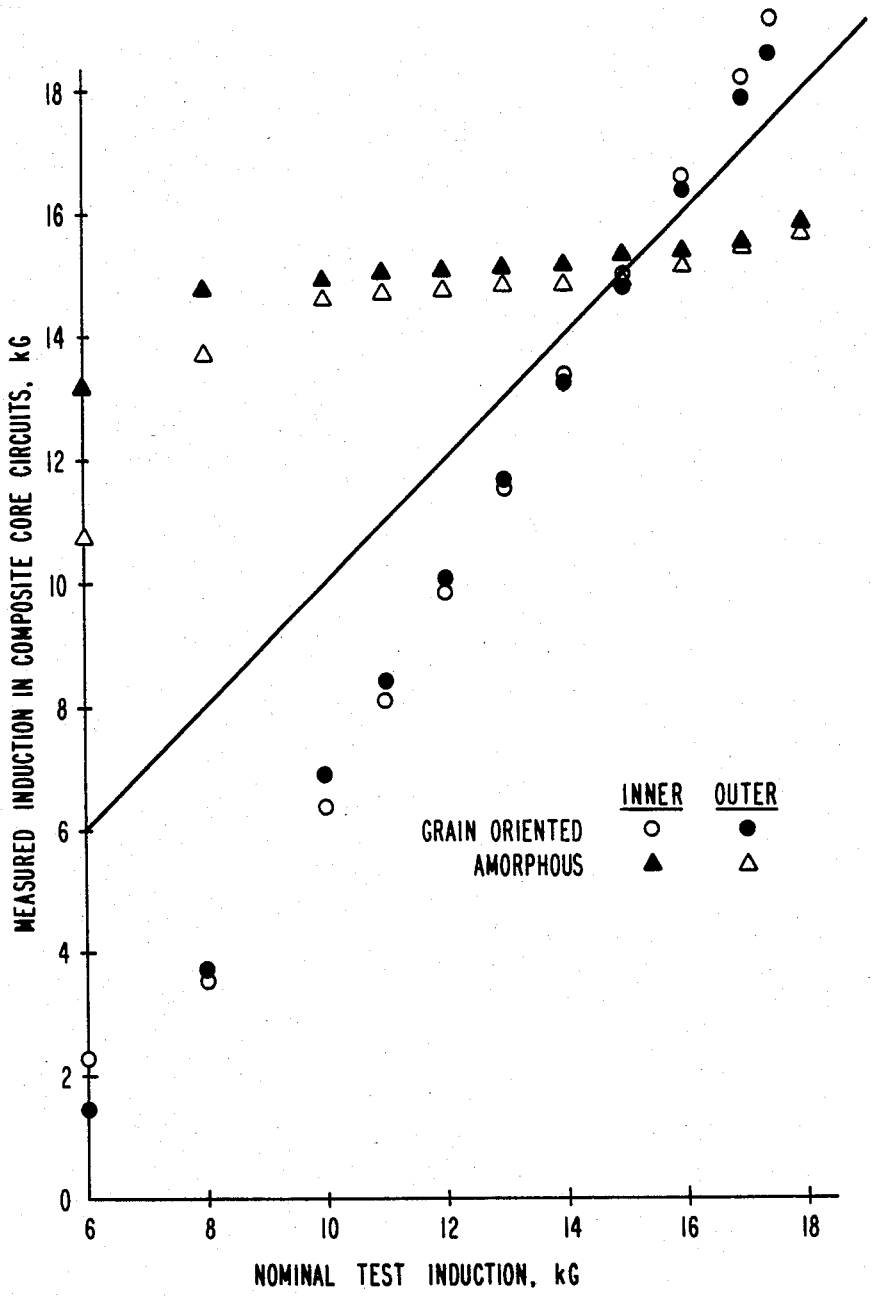
FIG. 4 is a graph of the induction in each section of the composite cores according to the present invention as a function of the overall induction.

However, in order to obtain a composite core which may operate above the saturation limited induction of the amorphous material, the amorphous material preferably should have a permeability of at least 50% of the permeability of the regular grain oriented or high permeability grain oriented steel forming the other loop or loops in the composite core at inductions up to about 15 kG. More preferably, the amorphous material has a permeability that is about equal to or greater than the grain oriented steel at inductions up to about 15 kG. METGLAS 2605 SC, tested above, and other amorphous alloys similar to it, have a permeability greater than high permeability grain oriented silicon steel up to about 15 kG. This results in the induction distribution shown in FIG. 4 between the two materials in composite cores according to the present invention. FIG. 4 is based on experimental data obtained from composite cores assembled from Table I loops. It can be seen in FIG. 4 that the induction in the METGLAS alloy loop is above that for the TRAN-COR H loop until an overall induction of about 15 kG is reached. Above about 15 kG, the induction in the amorphous alloy loop remains approximately constant, while the induction in the TRAN-COR H continues to rise. The diagonal line in FIG. 4 shows the nominal operating induction of the entire composite core. It can be clearly seen that the composite core having a ferromagnetic amorphous alloy loop, or loops, in combination with a grain oriented steel loop, or loops, allows the amorphous material to operate above its saturation limited induction, since the oriented steel absorbs most of the overvoltage flux.

The preceding description has demonstrated the present invention with composite cores containing two ferromagnetic circuits or loops. It is also clear from this description that the advantages arising out of the present invention are not limited to two loop cores but may also be obtained in composite cores containing more than two loops. For example, composite cores containing two or more amorphous loops and at least one grain oriented loop are contemplated. Composite cores according to the present invention containing two or more grain oriented steel loops and at least one amorphous loop are also contemplated. The grain oriented loops may be all regular grain oriented, all high permeability grain oriented, or there may be a loop of regular oriented steel and a loop of high permeability steel. The regular grain oriented and high permeability grain oriented steel loops may be arranged as described in U.S. Pat. No. 4,205,288, whose specification is hereby incorporated by reference.

While the foregoing examples have demonstrated the invention with wound core examples, the present invention is also applicable to stacked core designs.

Figure 5:
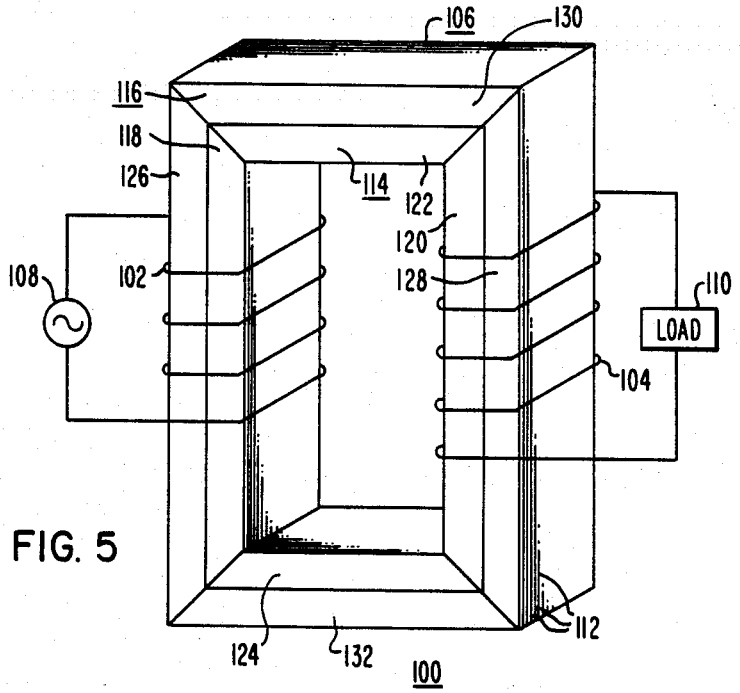
FIG. 5 is a partially schematic and partially diagrammatic perspective view of an electrical transformer constructed according to another embodiment of the invention.

FIG. 5 is a partially schematic and partially diagrammatic perspective view of a transformer 100 constructed according to an embodiment of the invention which utilizes a stacked-type magnetic core. More specifically, transformer 100 includes primary and secondary windings 102 and 104 respectively. Primary winding 102 is disposed to induce the magnetic flux into a ferromagnetic core 106 and is adapted for connection to a source 108 of alternating potential. Secondary winding 104 is adapted for connection to a load circuit 110.

Ferromagnetic core 106 is a composite ferromagnetic core having a plurality of superposed layers 112 of magnetic laminations. Each layer 112 of laminations includes inner and outer loops or ferromagnetic circuits 114 and 116.

One loop, either the outer 116, or inner 114, is made of amorphous material laminations, while the other loop is made of grain oriented steel laminations. Where it is desired to minimize core losses, it is preferred that outer loop 116 include the amorphous material.

The inner loop 114 includes first and second leg laminations 118 and 120, respectively, and upper and lower yoke laminations 122 and 124, respectively. The outer loop includes first and second leg laminations 126 and 128, respectively, and upper and lower yoke laminations 130 and 132, respectively. Leg laminations 118 and 126 are assembled in side-by-side relation to provide a composite lamination for one of the winding legs, and leg laminations 120 and 128 are assembled in side-by-side relation to provide a composite lamination for the other of the winding legs. In like manner, upper yoke laminations 122 and 130 are assembled in side-by-side relation, and lower yoke laminations 124 and 134 are assembled in side-by-side relation, to provide composite upper and lower yoke laminations, respectively. It should be further noted that there is no one-to-one correspondence between inner and outer laminations, since the amorphous laminations typically have a thickness between about 0.001 and 0.003 inches, and are therefore significantly thinner than the grain oriented steel laminations.

Figure 6:
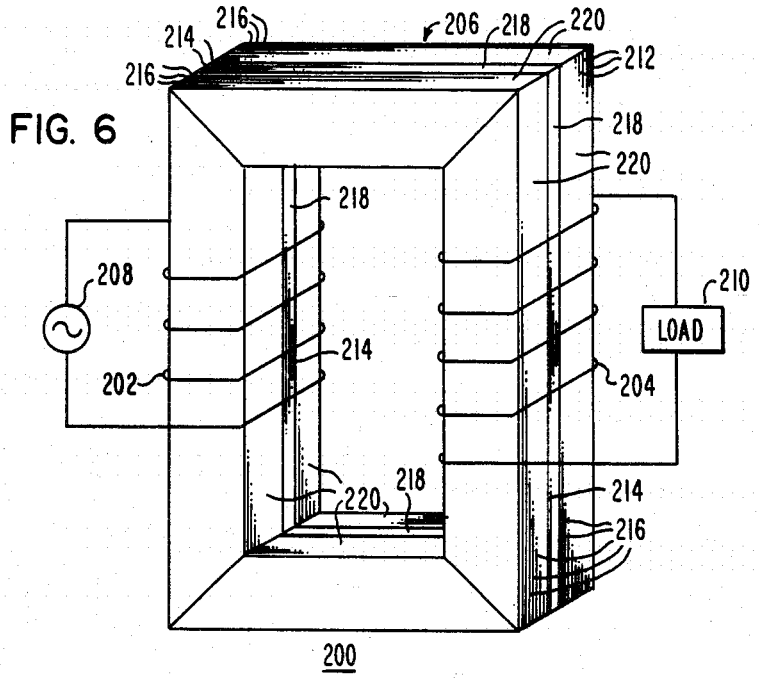
FIG. 6 is a partially schematic and partially diagrammatic perspective view of an electrical transformer constructed according to another embodiment of the invention.

FIG. 6 is a partially schematic and partially diagrammatic perspective view of a transformer 200 constructed according to another embodiment of the invention which utilizes a stacked type magnetic core. More specifically, transformer 200 includes primary and secondary windings 202 and 204, respectively, disposed to induce the magnetic flux into a ferromagnetic core 206. Primary winding 202 is adapted for connection to a source 208 of alternating potential, and secondary winding 204 is adapted for connection to a load circuit 210.

Ferromagnetic core 206 is a composite magnetic core having a plurality of superposed laminations 212 of ferromagnetic material. Each lamination 212 is either an amorphous material lamination 214 or an oriented steel lamination 216. As shown in the embodiment of FIG. 6, the amorphous laminations 214 may be grouped together in one layer 218 pressed between layers 220 of grain oriented steel laminations 216. In this manner, the flexible, but brittle, amorphous laminations 214 are fully supported by the more rigid grain oriented steel laminations 216. In an alternate embodiment, similar to the embodiment shown in FIG. 6, the amorphous laminations may be distributed between the grain oriented steel laminations, rather than being together to form one layer of amorphous laminations as shown in FIG. 6.

Other embodiments of the invention will be apparent to those skilled in the art from a consideration of this specification or practice of the invention disclosed herein. It is intended that the specification and examples be considered exemplary only, with the true scope and spirit of the invention being indicated by the following claims.

We claim:

1. A ferromagnetic core, for use in a power transformer having an operation induction, B, wherein said core comprises:

a plurality of ferromagnetic circuits;

said plurality of ferromagnetic circuits being constructed of at least two ferromagnetic materials having different saturation limited inductions;

a first ferromagnetic circuit of said plurality of ferromagnetic circuits being constructed of an iron base amorphous material having a saturation limited induction, $B_1$;

a second ferromagnetic circuit of said plurality of ferromagnetic circuits being constructed of a grain oriented electrical steel having a saturation limited induction, $B_2$;

and wherein said operating induction, B is between $B_1$ and $B_2$.

2. The ferromagnetic core according to claim 1 wherein said second ferromagnetic circuit structurally supports said first ferromagnetic circuits.

3. The ferromagnetic core according to claim 1 wherein the permeability of said amorphous material is at least about 50% of the permeability of said grain oriented electrical steel at like levels of induction up to about 15 kG.

4. The ferromagnetic core according to claim 1 wherein the permeability of said amorphous material is at least about equal to the permeability of said grain oriented electrical steel at like levels of induction up to about 15 kG.

5. The ferromagnetic core according to claim 1 wherein the operating induction is between about 15 and about 18 kG.

6. The ferromagnetic core according to claim 1 wherein said plurality of ferromagnetic circuits are parallel and adjacent ferromagnetic circuits.

7. The ferromagnetic core according to claim 6 wherein said plurality of ferromagnetic circuits are concentric ferromagnetic circuits.

8. The ferromagnetic core according to claim 1 wherein said plurality of ferromagnetic circuits are concentric ferromagnetic circuits.

9. An electrical power transformer for transmitting and distributing electrical power in an electrical power system, comprising:

a wound ferromagnetic core;

said core being constructed to provide a plurality of ferromagnetic circuits;

said plurality of ferromagnetic circuits being constructed of at least two ferromagnetic materials having different saturation limited inductions, a first ferromagnetic circuit of said plurality of ferromagnetic circuits being constructed of a ferromagnetic amorphous material;

a second ferromagnetic circuit of said plurality of ferromagnetic circuits being constructed of a grain oriented electrical steel in a stress relieved condition;

first and second electrical windings each disposed to link said plurality of ferromagnetic circuits;

said first and second electrical windings being adapted for connection to a source of electrical potential and to a load circuit, respectively;

and an operating induction between the saturation limited inductions of said ferromagnetic amorphous material and said grain oriented electrical steel.

10. The transformer according to claim 9 wherein said second ferromagnetic circuit structurally supports said first ferromagnetic circuit.

11. The transformer according to claim 9 wherein the permeability of said ferromagnetic amorphous material is at least equal to the permeability of said grain oriented electrical steel at like levels of induction up to about 15 kG.

12. An electrical power transformer for transmitting and distributing electrical power in an electrical power system, comprising:

a ferromagnetic core;

said core being constructed to provide inner and outer ferromagnetic circuits;

said inner and outer magnetic circuits being constructed of ferromagnetic materials having different permeabilities at like levels of induction up to about 15 kG with the inner ferromagnetic circuit being constructed of the material having the lower permeability;

said outer ferromagnetic circuits being constructed of a ferromagnetic amorphous material;

said inner ferromagnetic circuit being constructed of a grain oriented electrical steel;

first and second electrical windings each disposed to link said inner and outer ferromagnetic circuits;

and said first and second electrical windings being adapted for connection to a source of electrical potential and to a load circuit, respectively.

13. The transformer according to claim 12 wherein said inner and outer ferromagnetic circuits are concentric and parallel ferromagnetic circuits.

14. The transformer according to claim 13 wherein said inner and outer ferromagnetic circuits are adjacent ferromagnetic circuits.

15. A method of operating an electrical power distribution transformer having a ferromagnetic core, said core being constructed to provide a plurality of ferromagnetic circuits, said plurality of ferromagnetic circuits being constructed of at least two ferromagnetic materials having different saturation limited inductions, a first ferromagnetic circuit of said plurality of ferromagnetic circuits being constructed of a ferromagnetic amorphous material, a second ferromagnetic circuit of said plurality of ferromagnetic circuits being constructed of a grain oriented electrical steel, and first and second electrical windings each disposed to link said plurality of ferromagnetic circuits, said first and second electrical windings being adapted for connection to a source of electrical potential and to a load circuit, respectively, and wherein said method comprising the step of:

operating said first ferromagnetic circuit at an induction greater than the saturation limited induction of said ferromagnetic amorphous material.

16. The method according to claim 15 wherein said second ferromagnetic circuit is operated at an induction less than the saturation limited induction of said grain oriented electrical steel.

17. An electrical power transformer for transmitting and distributing electrical power in an electrical power system, comprising:

a wound ferromagnetic core;

said core being constructed to provide a single inner ferromagnetic circuit and a single outer ferromagnetic circuit;

said inner and outer magnetic circuits being constructed of ferromagnetic materials having different watt losses at like levels of induction with the inner ferromagnetic circuit being constructed of the material having the higher watt losses;

said outer ferromagnetic circuit being constructed of a ferromagnetic amorphous material;

said inner ferromagnetic circuit being constructed of a grain oriented electrical steel;

first and second elecrical windings each disposed to link said inner and outer ferromagnetic circuits;

and said first and second electrical windings being adapted for connection to a source of electrical potential and to a load circuit, respectively.

18. The power transformer according to claim 17 further comprising:

said inner ferromagnetic circuit structurally supporting said outer ferromagnetic circuit.

* * * * *